US009138074B2

(12) United States Patent
Arne et al.

(10) Patent No.: US 9,138,074 B2
(45) Date of Patent: Sep. 22, 2015

(54) DISPLAY FIXTURES

(75) Inventors: Erica Marie Arne, Minneapolis, MN (US); Joseph Stukenberg, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 808 days.

(21) Appl. No.: 13/096,879

(22) Filed: Apr. 28, 2011

(65) Prior Publication Data

US 2011/0316396 A1 Dec. 29, 2011

Related U.S. Application Data

(63) Continuation-in-part of application No. 12/826,472, filed on Jun. 29, 2010, now abandoned.

(51) Int. Cl.

| | |
|---|---|
| ***A47B 77/00*** | (2006.01) |
| ***A47F 3/00*** | (2006.01) |
| ***A47F 9/00*** | (2006.01) |
| *A47F 7/02* | (2006.01) |

(52) U.S. Cl.

CPC . *A47F 3/005* (2013.01); *A47F 9/00* (2013.01); *A47F 7/02* (2013.01); *Y10T 29/49826* (2015.01)

(58) Field of Classification Search

USPC ..... 312/107, 108, 115, 257.1, 265.1–265.6, 312/140.1–140.4, 198–203, 111, 114; 108/64; 248/243; 52/33, 134, 27, 36, 52/169.2, 169.3, 234

See application file for complete search history.

(56) References Cited

U.S. PATENT DOCUMENTS

| | | | | |
|---|---|---|---|---|
| 810,243 | A | 1/1906 | Wright | |
| 839,639 | A | 12/1906 | Pulper | |
| 870,314 | A | 11/1907 | Pierce | |
| 1,435,395 | A | 11/1922 | Howard | |
| 1,528,243 | A | 3/1925 | Briggs | |
| 1,647,889 | A | 11/1927 | Saunders | |
| 1,766,409 | A | 6/1930 | Stocks | |
| 1,861,671 | A | 6/1932 | Webb | |
| 2,171,378 | A | 8/1939 | Urbanek | |
| 2,285,962 | A | 6/1942 | Foulkes | |
| 2,878,090 | A * | 3/1959 | Holderle et al. | 312/114 |
| 3,716,281 | A * | 2/1973 | Rudder | 312/114 |
| 3,717,395 | A * | 2/1973 | Spielvogel et al. | 312/114 |

(Continued)

OTHER PUBLICATIONS

U.S. Appl. No. 29/358,811, filed Apr. 1, 2010 (8 pages).

*Primary Examiner* — Matthew Ing
*Assistant Examiner* — Timothy M Ayres
(74) *Attorney, Agent, or Firm* — Griffiths & Seaton PLLC; JoAnn M. Seaton

(57) ABSTRACT

In one implementation, a jewelry product display system includes jewelry display cases having translucent panels and product displayed on top of, rather than inside, the display cases. In certain embodiments the display cases may be laid out so that customer can approach both sides of the display case. In some implementations the display cases are arranged to form, when viewed from above, two L-shaped counters that face one another with a low central island positioned between the L-shaped jewelry display counters. In various embodiments this arrangement may increase the sales rate by making product more readily accessible to customers while at the same time keeping theft rates low by mimicking a traditional jewelry environment, which customers may associate with intensified security monitoring, and by creating a shopping environment which is relatively tightly contained, which may tend to deter shoplifting.

19 Claims, 6 Drawing Sheets

(56) References Cited

U.S. PATENT DOCUMENTS

| | | | | | |
|---|---|---|---|---|---|
| D242,192 | S | | 11/1976 | Robinson | |
| D244,889 | S | | 7/1977 | Neuschwander | |
| 4,154,027 | A | * | 5/1979 | Searcy | 52/33 |
| D257,995 | S | | 1/1981 | Mikkelsen et al. | |
| 4,288,948 | A | | 9/1981 | Harris | |
| D262,926 | S | * | 2/1982 | Woolford | D6/471 |
| D267,293 | S | | 12/1982 | Georgi | |
| D279,739 | S | * | 7/1985 | Aspenwall | D6/471 |
| 4,572,593 | A | * | 2/1986 | Takamizawa et al. | 312/114 |
| D350,864 | S | * | 9/1994 | Kane et al. | D6/438 |
| D410,620 | S | | 6/1999 | Sacco et al. | |
| D426,033 | S | | 5/2000 | Rooks | |
| 6,056,130 | A | * | 5/2000 | Ovadia | 211/85.2 |
| D429,085 | S | | 8/2000 | Welty et al. | |
| D450,486 | S | | 11/2001 | Stafford | |
| D461,061 | S | | 8/2002 | Kent | |
| D611,733 | S | | 3/2010 | Stukenberg | |
| D611,734 | S | | 3/2010 | Stukenberg et al. | |
| D611,735 | S | | 3/2010 | Stukenberg | |
| D617,558 | S | | 6/2010 | Myers | |
| 2007/0181515 | A1 | * | 8/2007 | Levi et al. | 211/85.3 |
| 2010/0254125 | A1 | * | 10/2010 | Jones et al. | 362/227 |

* cited by examiner

DISPLAY FIXTURES

CROSS-REFERENCE TO RELATED APPLICATION

This application is a continuation-in-part of and claims priority to U.S. patent application Ser. No. 12/826,472 by Arne et al., entitled "Display Fixtures", filed Jun. 29, 2010.

BACKGROUND

Retail stores typically present products to patrons on or in displays. Product displays include shelves, display spinners, peg boards with hooks, counters, and display cases. A single retail store may include each type of display in a different region of the store and may use a given type of displays for different types of products.

Display cases are often used to display products of substantial value which are likely targets for shoplifters. For example, fishing reels may be displayed in a transparent display case in the sporting goods department. Electronic games for personal entertainment devices, often sold in the form of game cartridges, may be housed in a locked glass front display case. Jewelry might be displayed in a manner similar to the fishing reels, described above, with the addition of counter top spinners to display items such as necklaces and earrings.

When a customer asks to inspect a jewelry item in the display case, an employee of the retail store unlocks the display case and allows the customer to view and interact with the product. This approach has the advantage of reducing the incidence of shoplifting for the high value jewelry items, particularly those stored within the secure display case.

Given the secure nature of such jewelry displays, the individual display cases are often arranged in a rectangular pattern having one or more gaps that permit employees to access the interior area. This area is usually restricted to employees only. It sometimes includes cash registers, additional jewelry inventory, and other resources for use by store employees.

Alternatively, such display cases might be arranged along a wall. In such arrangements the employees enter at the end of the line of display cases and the wall typically has cabinetry and shelving containing registers, inventory, or other materials for use by store personnel only.

SUMMARY

In one implementation, a jewelry product display system includes jewelry display cases having translucent panels and product displayed on top of, rather than inside, the display cases. In certain embodiments the display cases may be laid out so that customer can approach both sides of the display case. In some implementations the display cases are arranged to form, when viewed from above, two L-shaped counters that face one another with a low central island positioned between the L-shaped jewelry display counters. In various embodiments this arrangement may increase the sales rate by making product more readily accessible to customers while at the same time keeping theft rates low by mimicking a traditional jewelry environment, which customers may associate with intensified security monitoring, and by creating a shopping environment which is relatively tightly contained, which may tend to deter shoplifting.

In one implementation, some of the display cases may include support racks on their upper surfaces. For example, the upper surfaces may include keyed receptacles that mate with jewelry display racks having projections having complementary configurations. In other implementations, the L-shaped sections may include at their elbows a low profile display cases having supported thereon a jewelry spinner that projects substantially above the top surface of the display case.

The details of one or more implementations are set forth in the accompanying drawing and description below. Other features, objects, and advantages will be apparent from the description and drawings, and from the claims.

DESCRIPTION OF DRAWINGS

Like reference symbols in various drawing indicate like elements.

DETAILED DESCRIPTION OF ILLUSTRATIVE IMPLEMENTATIONS

One illustrative product display system is used to present products or objects to a retail customer. The product display system includes two "L" shaped display counters and one rectangular display counter island positioned between the two "L" shaped counters. A customer is able to approach all sides of the product display system in order to view products presented on the product display system. Each of the "L" shaped counters include a first and a second counter portion, with the first portion extending along a horizontal axis and the second portion extending along a lateral axis perpendicular to the horizontal axis. The second portions of the two "L" shaped display counters extend towards one another and are spaced apart. The first portions of the two "L" shaped counters are parallel to each other. In some implementations, the layout of the product display system increases sales. In some implementations, the product display system creates a sense of being "closed in" or otherwise provides a sense of increased security monitoring and thereby deters shoplifting.

The two "L" shaped display counters include a lower base portion and an upper display portion. In some implementations, the upper display portion is translucent or transparent. In some implementations, translucent display portions are backlit from an internal cavity of the counter in order to allow a customer to more easily view products presented on the display portion.

In some implementations, the height of the display counter island is the same as the height of the two "L" shaped display counters. In other implementations, the height of the island is less than the height of the two "L" shaped display counters.

In some implementations, the tops of the counters include keyed openings. In some implementations, the keyed openings receive display racks that present products to a customer. The keyed openings mate with product displays (e.g., a display spinner or display shelf) having complementary keys in order to present products to a customer.

The product display system is used to present jewelry to a customer at a retail store. In other implementations, the product display system presents objects in a museum. In still other implementations, the product display system presents electronics to a customer at a retail store. For example, cellular phones or music players rest on a top surface of the upper display portions of the two "L" shaped counters and the display counter island.

While reference will be made below to a jewelry display system, other forms of display systems are considered in accordance with the description below.

Figure 1:
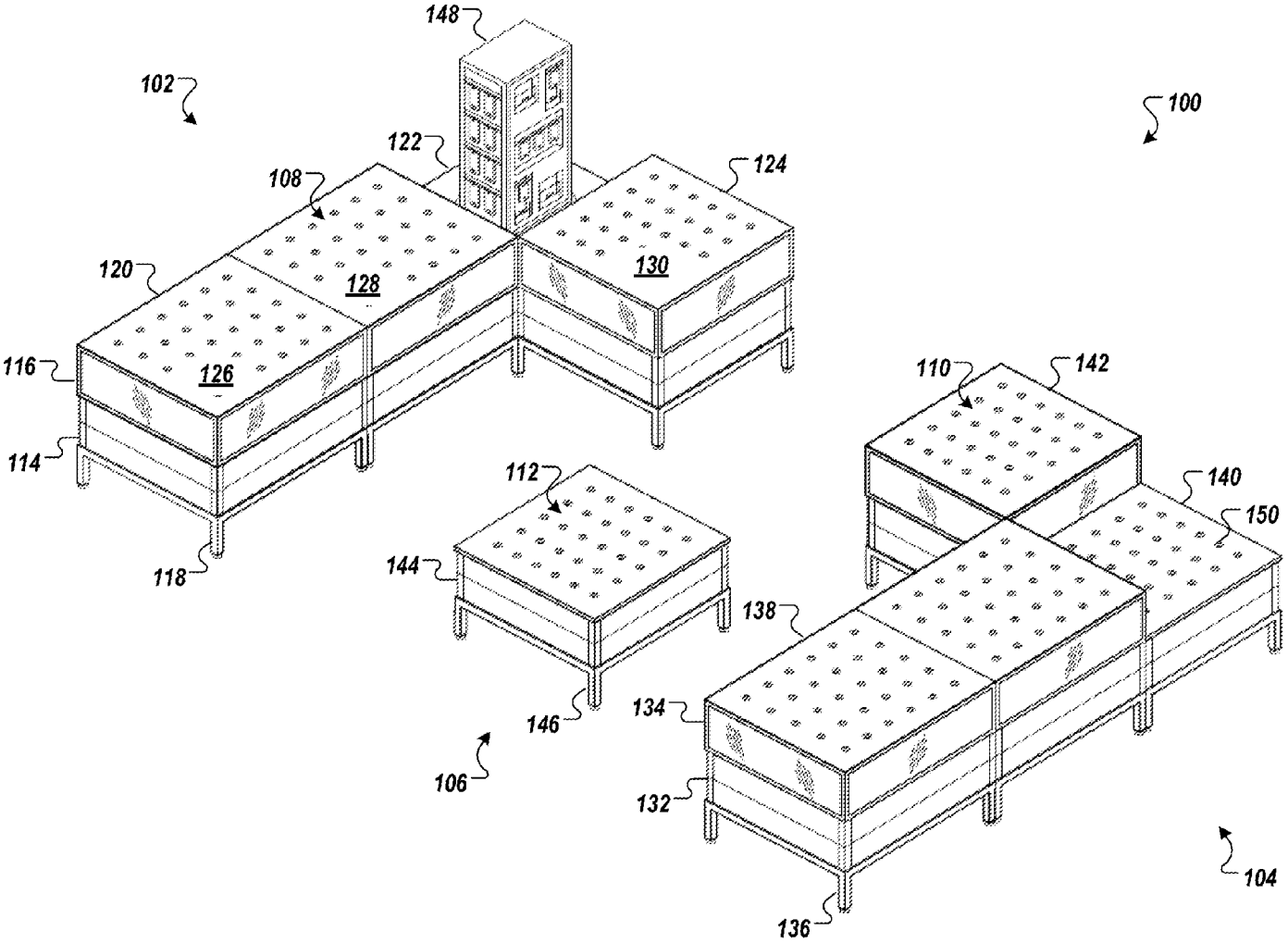
FIG. 1 shows a perspective back view of an example product display system with three display counters.

FIG. 1 shows a perspective view of an example of a product display system 100. The product display system 100 is located at a retail store. The product display system 100 includes a first "L" shaped counter 102, a second "L" shaped counter 104, and a first display counter island 106. Display racks, shelves, and spinners rest upon the first "L" shaped counter 102, the second "L" shaped counter 104, and the first display counter island 106 in order to present jewelry to a customer at the retail store, as described below. In other implementations, electronic devices or museum artifacts rest upon a first top surface 108 of the first "L" shaped counter 102, a second top surface 110 of the second "L" shaped counter 104, and a third top surface 112 of the first display counter island 106.

In some implementations, a customer is able to approach all sides of the first "L" shaped counter 102, the second "L" shaped counter 104, and the first display counter island 106. In some implementations, allowing a customer to approach all sides of the product display system 100 increases sales. For example, more customers interact with the product display system 100 at the same time by approaching multiple sides of the product display system 100 compared to approaching only the outside of the product display system 100.

In some implementations, the product display system 100 appears similar to a traditional jewelry display counter that is only approachable from a single side. For example, the product display system 100 creates a sense of security and reduces shoplifting by appearing similar to a traditional jewelry display counter.

The first "L" shaped counter 102 includes a first lower base portion 114 and a first upper display portion 116. The first lower base portion 114 is made from plastic. In other implementations, the first lower base portion 114 is made from wood. In some implementations, the first lower base portion 114 is laminated. One or more legs 118 support the first lower base portion 114. In some implementations, the first lower base portion 114 includes a drawer or shelf in the interior of the first lower base portion 114.

The first upper display portion 116 is translucent. The first upper display portion 116 is made from plastic (e.g., acrylic). In other implementations, the first upper display portion 116 is made from glass. For example, the first upper display portion 116 includes frosted glass. In some implementations, the first upper display portion 116 is hollow and includes a base made from wood and the top and sides of the first upper display portion 116 are made from plastic. The top, bottom, and sides of the first upper display portion 116 are held together with a metal frame.

In some implementations, the first upper display portion 116 includes a light within a hollow interior of the first upper display portion 116. In some implementations, the light enhances the appearance of the product display system 100. In some implementations, the light attracts a customer to products presented on the product display system 100.

In some implementations, the first upper display portion 116 and the first lower base portion 114 include three sections, a first longitudinal section 120, a first corner section 122, and a first lateral section 124. Each of the first longitudinal section 120, the first corner section 122, and the first lateral section 124 are manufactured as separate pieces. The first longitudinal section 120 and the first lateral section 124 are the same height. For example, the first longitudinal section 120 and the first lateral section 124 have a height between about 30 inches and about 45 inches. For example, the first longitudinal section 120 and the first lateral section 124 have a height between about 33 inches and about 40 inches, e.g., a height of about 34 inches. The first corner section 122 has a height less than the height of the first longitudinal section 120. For example, the first corner section 122 has a height between about 15 inches and about 30 inches. For example, the first corner section 122 has a height between about 20 inches and 25 inches, e.g., a height of about 22 inches.

In some implementations, the first longitudinal section 120 or the first lateral section 124 include more than one section. For example, the first longitudinal section 120 includes a first display section 126 and a second display section 128 and the first lateral section 124 includes a third display section 130. In another example, the first longitudinal section 120 includes two display sections and the first lateral section 124 includes two display sections. In some implementations, each of the first display section 126, the second display section 128, and the third display section 130 include a light.

In some implementations, the first longitudinal section 120 has a width between about 80 inches and about 120 inches. The first longitudinal section 120 has a depth between about 20 inches and about 40 inches. For example, the first longitudinal section 120 has a width between about 90 inches and about 110 inches. For example, the first longitudinal section 120 has a depth between about 25 inches and about 35 inches. In some implementations, the first longitudinal section 120 has a width of about 100 inches and a depth of about 30 inches. The first longitudinal section 120 has a rectangular vertical cross section and a rectangular horizontal cross section.

The first lateral section 124 has a width between about 40 inches and about 60 inches. The first lateral section 124 has a depth between about 20 inches and about 40 inches. For example, the first lateral section 124 has a width between about 45 inches and about 55 inches. For example, the first lateral section 124 has a depth between about 25 inches and about 35 inches. In some implementations, the first lateral section 124 has a width of about 50 inches and a depth of about 30 inches. The first lateral section 124 has a rectangular vertical cross section and a rectangular horizontal cross section.

The first corner section 122 has a rectangular vertical cross section and a square horizontal cross section. In some implementations, the first corner section 122 has a circular horizontal cross section. The first corner section 122 has a width between about 20 inches and about 60 inches. For example, the first corner section 122 has a width between about 25 inches and about 50 inches. The first corner section 122 has a depth between about 20 inches and about 40 inches. For example, the first corner section 122 has a depth between about 25 inches and about 35 inches. In some implementations, the first corner section 122 has a width and depth of about 30 inches.

The second "L" shaped counter 104 includes a second lower base portion 132 and a second upper display portion 134. The second lower base portion 132 has a shape and dimensions similar to the first lower base portion 114 as described above with reference to the first "L" shaped counter 102. The second upper display portion 134 has a shape and dimensions similar to the first upper display portion 116.

In some implementations, the size and shape of the second upper display portion 134 complement the size and shape of the second lower base portion 132. For example, when the second lower base portion 132 has a circular horizontal cross section, the second upper display portion 134 has an elliptical horizontal cross section.

The second lower base portion 132 is supported by one or more legs 136. In some implementations, the second lower base portion 132 and the legs 136 are made from a unitary piece.

In some implementations, the second lower base portion 132 and the second upper display portion 134 include three sections, a second longitudinal section 138, a second corner section 140, and a second lateral section 142. The second longitudinal section 138 has the same shape and dimensions as the first longitudinal section 120. The second corner section 140 has the same shape and dimensions as the first corner section 122. The second lateral section 142 has the same shape and dimensions as the first lateral section 124.

The first lateral section 124 and the second lateral section 142 are spaced apart. For example, the distance between the first lateral section 124 and the second lateral section 142 is between about 36 inches and about 72 inches. For example, the distance separating the first lateral section 124 and the second lateral section 142 is between about 40 inches and about 60 inches. In some implementations, the distance is about 50 inches.

The first display counter island 106 includes a third lower base portion 144 and one or more legs 146. The third lower base portion 144 has a rectangular vertical cross section and a rectangular horizontal cross section. The third lower base portion 144 has a height between about 20 inches and about 36 inches. For example, the third lower base portion 144 has a height between about 21 inches and about 30 inches, e.g., a height of 21 13/16 inches. The third lower base portion 144 has a width between about 20 inches and about 40 inches. For example, the third lower base portion 144 has a width between about 25 inches and about 35 inches, e.g., a width of 29¾ inches. The third lower base portion 144 has a depth between about 20 inches and about 40 inches. For example, the third lower base portion 144 has a depth between about 25 inches and about 35 inches, e.g., and a depth of about 30 inches.

The first display counter island 106 is spaced evenly between the first longitudinal section 120 and the second longitudinal section 138. For example, the first display counter island 106 is between about 36 inches and about 84 inches apart from the first longitudinal section 120. For example, the first display counter island 106 is between about 50 inches and about 70 inches apart from the first longitudinal section 120. For example, the first display counter island 106 is 60 inches apart from the first longitudinal section 120 and 60 inches apart from the second longitudinal section 138. In some implementations, the distance between the first longitudinal section 120 and the first display counter island 106 is different than the distance between the first display counter island 106 and the second longitudinal section 138.

The first display counter island 106 is spaced apart from the first lateral section 124 and the second lateral section 142. For example, the distance between the first display counter island 106 and the first lateral section 124 is between about 30 inches and about 72 inches. Preferably, the distance between the first display counter island 106 and the first lateral section 124 is between about 30 inches and about 48 inches, e.g., about 36 inches. In some implementations, the first display counter island 106 is the same distance from the first lateral section 124 and the second lateral section 142.

A display spinner 148 rests upon the first corner section 122. A similar display spinner rests upon the second corner section 140. The top surface of the first corner section 122 and the second corner section 140 include one or more keyed openings 150. The keyed openings 150 receive rods extending downward from the bottom of the display spinner 148 in order to hold the display spinner 148 in place on the counter. In some implementations, the keyed openings 150 receive inserts from display racks used to present products to a customer, as described in more detail below.

The display spinner 148 presents products to a customer. For example, a customer rotates the display spinner 148 while browsing through products presented on the display spinner 148.

A display spinner (not shown) rests upon the third top surface 112 of the first display counter island 106. The third top surface 112 includes keyed openings that receive complementary inserts that extend downward from the bottom of the display spinner. For example, the keyed openings allow the display spinner to attach to the first display counter island 106 and stay in place without moving. Alternatively, apertures in the keys permit the use of a threaded bolt or pin to attach the spinner to the island.

Figure 2:
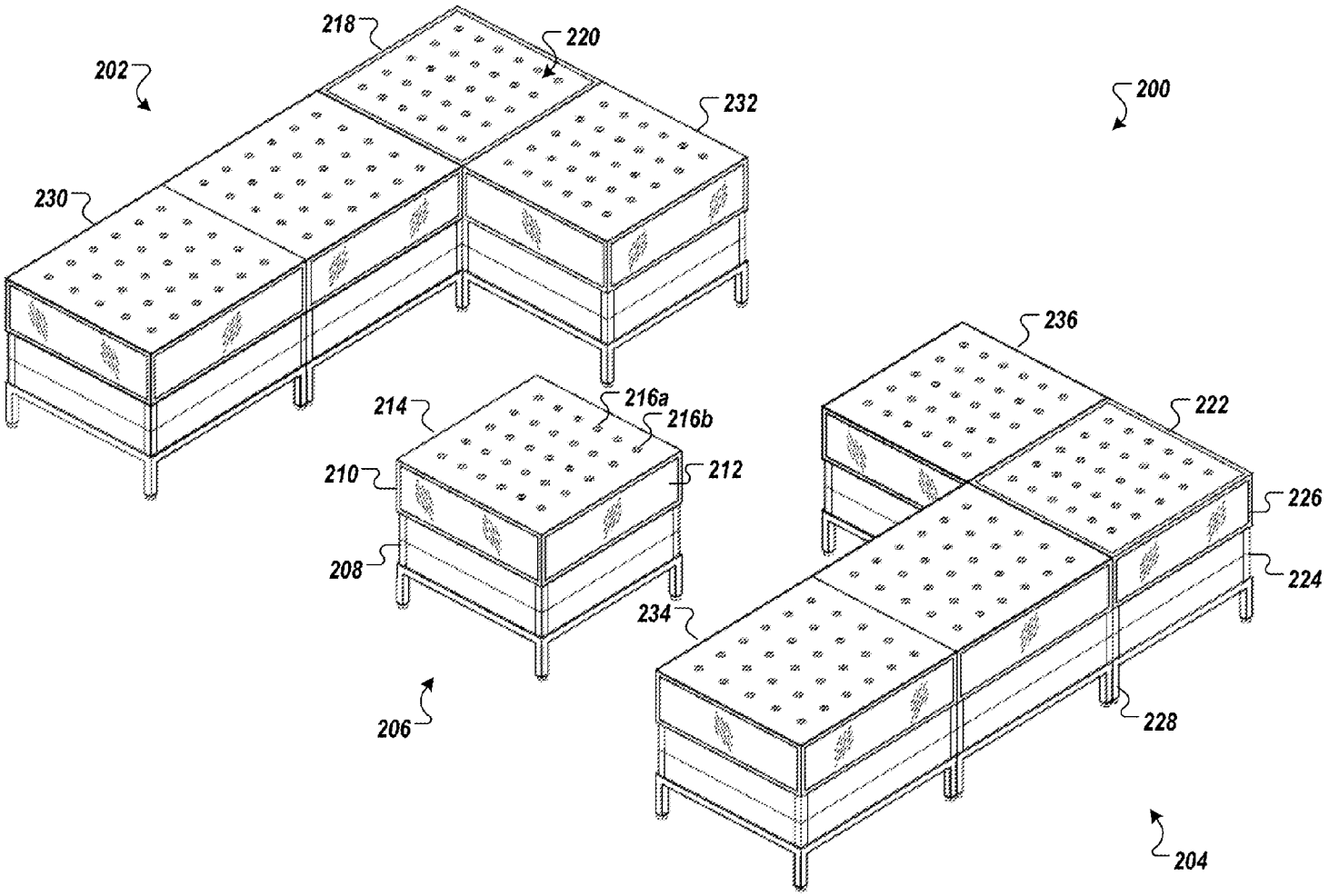
FIG. 2 shows a perspective back view of another example product display system with a full height island.

FIG. 2 shows a perspective view of another example of a product display system 200. The product display system 200 includes a third "L" shaped counter 202, a fourth "L" shaped counter 204, and a second display counter island 206.

The second display counter island 206 includes a fourth lower base portion 208 and a fourth upper display portion 210.

In some implementations, the fourth lower base portion 208 is similar to the third lower base portion 144. For example, the second display counter island 206 is modular and removing the fourth upper display portion 210 creates a display counter island similar to the first display counter island 106. For example, keyed openings on the top of the fourth lower base portion 208 receive rods extending downward from the bottom of the fourth upper display portion 210 in order to hold the fourth upper display portion 210 in place on the fourth lower base portion 208.

The fourth upper display portion 210 includes four side panels 212, a top panel 214, and a bottom panel (not shown). The side panels 212, the top panel 214, and the bottom panel are connected with a metal frame. Each of the side panels 212 and the bottom panel are made from plastic. The top panel 214 is made from metal and includes sixty-six keyed openings 216*a-b*. The keyed openings 216*a-b* are configured to receive display racks as described in more detail below. In some implementations, the top panel 214 includes between twenty and one hundred keyed openings, preferably between thirty-six and sixty-six keyed openings.

A customer is able to view products presented on the second display counter island 206 (or display racks on the second display counter island 206) from all sides of the second display counter island 206. A customer is able to view and interact with products presented on the third "L" shaped counter 202, and the fourth "L" shaped counter 204 from all sides of the counters. In some implementations, the closeness of the counters creates a sense of store security and reduces the chance of a customer shoplifting products presented in the product display system 200.

The second display counter island 206 has a height between about 20 inches and about 40 inches. For example, the second display counter island 206 has a height between about 25 inches and about 35 inches, e.g., a height of about 34 inches. The second display counter island 206 has a width between about 36 inches and about 80 inches. For example, the second display counter island has a width between about 40 inches and about 72 inches, e.g., a width of 49¾ inches. The second display counter island 206 has a depth between about 20 inches and about 40 inches. For example, the second display counter island 206 has a depth between about 25 inches and about 35 inches, e.g., and a depth of about 30 inches. For example, the ends of the second display counter island 206 do not extend past the ends of the third "L" shaped counter 202 and the fourth "L" shaped counter 204. In some implementations, the second display counter island 206 has a width of about 64 inches and a depth of about 30 inches. For example, a near end of the second display counter island 206 coincides with the near ends of the third "L" shaped counter 202 and the fourth "L" shaped counter 204.

In some implementations, the second display counter island 206 includes two sections. For example, a first section is a half height counter (e.g., similar to the first display counter island 106) and a second section is a full height counter (e.g., similar to the second display counter island 206). For example, the second display counter island 206 has a width of about 80 inches and a depth of about 30 inches.

In certain embodiments, the second display counter island 206 is taller than the third "L" shaped counter 202. For example, the second display counter island has a height of 40 inches.

The third "L" shaped counter 202 includes a third corner section 218. The third corner section 218 has a height between about 20 inches and about 46 inches. For example, the third corner section 218 has a height between about 25 inches and about 40 inches, e.g., a height of about 34 inches. The third corner section 218 includes a top surface 220 for presenting jewelry. In some implementations, the top surface 220 includes thirty-six keyed openings for receiving jewelry display racks.

The fourth "L" shaped counter 204 includes a fourth corner section 222. The fourth corner section 222 has a shape and dimensions similar to the shape and dimensions of the third corner section 218.

The fourth corner section 222 includes a fifth lower base portion 224 and a fifth upper display portion 226. One or more legs 228 are connected to the fifth lower base portion 224.

The third "L" shaped counter 202 includes a third longitudinal section 230 and a third lateral section 232. The fourth "L" shaped counter includes a fourth longitudinal section 234 and a fourth lateral section 236. The third longitudinal section 230 and the fourth longitudinal section 234 are parallel and spaced between about 120 inches to about 200 inches apart from each other. For example, the third longitudinal section 230 and the fourth longitudinal section 234 are between about 120 inches to about 160 inches apart, e.g., about 150 inches apart from each other. For example, the third longitudinal section 230 extends along a first axis, the fourth longitudinal section 234 extends along a second axis, and the first axis is parallel to the second axis.

The third lateral section 232 extends perpendicularly from the third longitudinal section 230 and toward the fourth "L" shaped counter 204. For example, the third lateral section 232 extends along a third axis, and the third axis is perpendicular to the first axis. The fourth lateral section 236 extends perpendicularly from the fourth longitudinal section 234 and toward the third "L" shaped counter 202. For example, the fourth lateral section 236 extends along a fourth axis, and the fourth axis is perpendicular to the second axis.

The third lateral section 232 is between about 36 inches and about 90 inches apart from the fourth lateral section 236. For example, the third lateral section 232 and the fourth lateral section 236 are between about 48 inches and about 72 inches apart, e.g., the third lateral section 232 and the fourth lateral section 236 are about 50 inches apart. The third lateral section 232 and the fourth lateral section 236 extend along the same axis. The third axis and the fourth axis are coincident in certain embodiments.

Figure 3:
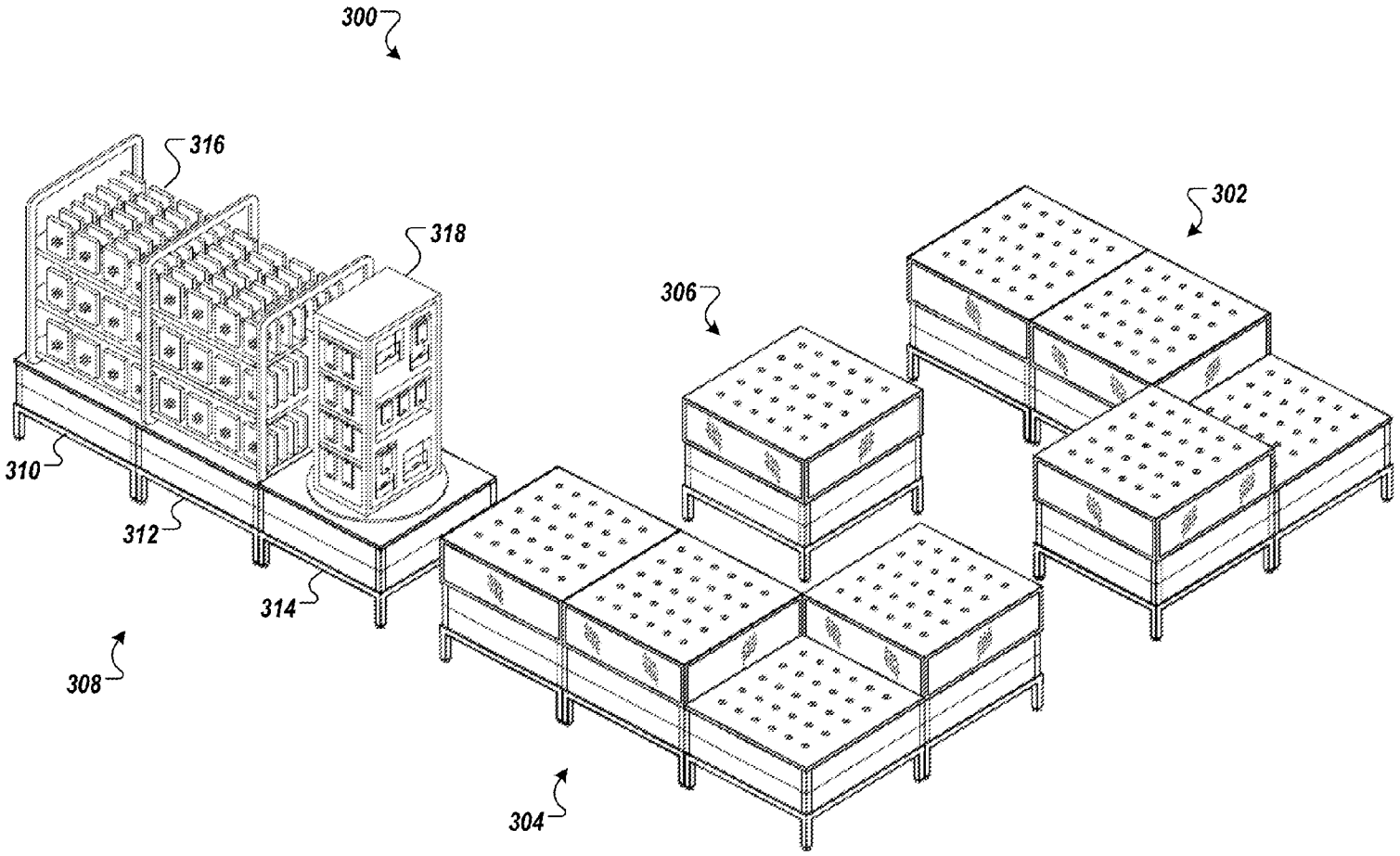
FIG. 3 shows a perspective front view of an example product display system.

FIG. 3 shows a front perspective view of an example of a product display system 300. In some implementations, the product display system 300 is the same as the product display system 100 or the product display system 200. The product display system 300 includes a fifth "L" shaped counter 302, a sixth "L" shaped counter 304, a third display counter island 306, and a display counter 308. The display counter 308 includes a first section 310, a second section 312, and a third section 314

The first section 310 and the second section 312 support one or more product display shelves 316. For example, jewelry is presented upon the product display shelves 316. In some implementations, frames supporting product hooks rest upon top surfaces of the first section 310 and the second section 312. The third section 314 supports a display spinner 318, described in more detail below. In other implementations, the first section 310, the second section 312, and the third section 314 include an upper display portion similar to the first lateral section 124 and described below with reference to FIG. 4.

In some implementations, the product display system 300 includes three display counters (e.g., the display counter 308). For example, a first display counter (e.g., the display counter 308) coincides with the sixth "L" shaped counter 304; a second display counter coincides with the third display counter island 306; and a third display counter coincides with the fifth "L" shaped counter 302.

Figure 4:
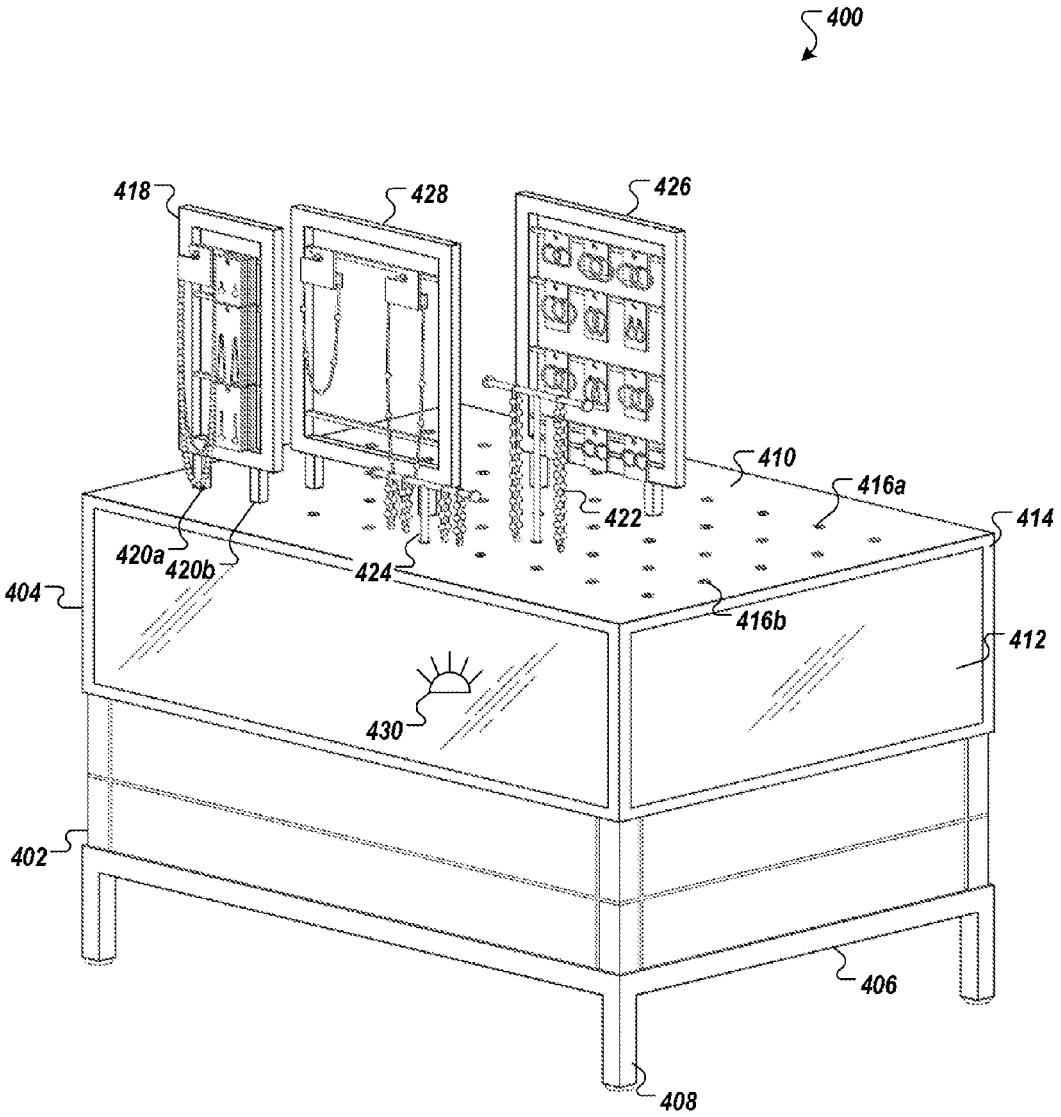
FIG. 4 shows a perspective view of an example section of a display counter.

FIG. 4 shows an example of a full height counter 400. The full height counter 400 supports a plurality of differently configured jewelry display racks. The jewelry display racks present jewelry to a customer.

The first longitudinal section 120 and the first lateral section 124 include a full height counter (e.g., similar to the full height counter 400). In some implementations, the first longitudinal section 120 includes two full height counters. For example, the two full height counters are connected together with clasps. In some implementations, the third corner section 218, the first display section 126, the third display section 130, the second display counter island 206, or the first section 310 are a full height counter (e.g., similar to the full height counter 400).

The full height counter 400 includes a lower base portion 402 and an upper display portion 404. The lower base portion 402 is made from wood. In some implementations, the lower base portion 402 is made from metal and in others it is made from plastic. In certain embodiments, the lower base portion 402 comprises a laminate with a wood core. The lower base portion 402 has a rectangular horizontal cross section and a rectangular vertical cross section.

The lower base portion 402 has a height between about 10 inches and about 20 inches. For example, the lower base portion 402 has a height between about 12 inches and about 18 inches, e.g., a height of about 14 inches. The lower base portion 402 has a width between about 30 inches and about 60 inches. For example, the lower base portion 402 has a width between about 40 inches and about 55 inches, e.g., a width of 48 inches. The lower base portion 402 has a depth between about 20 inches and about 40 inches. For example, the lower base portion 402 has a depth between about 25 inches and about 35 inches, e.g., and a depth of 28 inches. In some implementations, the lower base portion 402 has a square horizontal cross section. In some implementations, the lower base portion 402 has a square vertical cross section. In some implementations, the lower base portion 402 has an elliptical horizontal cross section.

The lower base portion 402 includes four side panels, a top panel, and a bottom panel. The interior of the lower base portion 402 is hollow. In some implementations, a wood frame attaches the panels of the lower base portion 402 together from the inside of the lower base portion. In some implementations, the frame is made from metal.

In some implementations, the lower base portion 402 includes a drawer in one of the sides. In some implementations, the lower base portion 402 includes a shelf and a door covering the shelf.

The lower base portion 402 is attached to a support frame 406. The support frame 406 is made from metal. The support frame 406 includes one or more legs 408. The support frame 406 and the legs 408 are made from a unitary piece. In some implementations, the support frame 406 is made from wood. In some implementations, the support frame 406 is made from plastic. In some implementations, the support frame 406 and each of the legs 408 are separate pieces.

The upper display portion 404 is made from glass and metal. For example, the upper display portion 404 includes a metal top 410, four glass sides 412, and a metal frame 414.

In some implementations, the upper display portion 404 includes two glass sides 412 and two plastic sides. For example, when the full height counter 400 is used as the first corner section 122, the two sides that are hidden are plastic. In some implementations, the two hidden sides are wood.

In certain implementations, part of the upper display portion 404 is made from glass or plastic, either translucent or opaque. In some implementations, two of the sides 412 are translucent plastic and the other two sides are opaque plastic.

The upper display portion 404 has a rectangular horizontal cross section and a rectangular vertical cross section. The upper display portion 404 has a height between about 10 inches and about 24 inches. For example, the upper display portion 404 has a height between about 12 inches and about 16 inches. The upper display portion 404 has a width between about 30 inches and about 75 inches. For example, the upper display portion 404 has a width between about 40 inches and about 60 inches, e.g., a width of about 50 inches. The upper display portion 404 has a depth between about 20 inches and about 40 inches. For example, the upper display portion 404 has a depth between about 25 inches and about 35 inches, e.g., and a depth of about 30 inches. In some implementations, the upper display portion 404 has a square horizontal cross section. In some implementations, the upper display portion 404 has a square vertical cross section. In some implementations, the upper display portion 404 has an elliptical horizontal cross section.

The top 410 includes sixty keyed openings 416*a-b* for supporting a display rack 418. In other implementations, the top 410 includes between about twenty-five keyed openings and about eighty keyed openings. The centers of the keyed openings 416*a-b* are evenly spaced between about 2 inches and about 12 inches apart, e.g., about 5 inches apart. Each of the keyed openings 416*a-b* may be formed in metal inserts to the top 410, which may be otherwise comprised of wood and protective laminate. In other implementations, the top 410 is formed in a mold with the keyed openings 416*a-b* defined in the mold. In some implementations, each of the keyed openings 416*a-b* is milled or drilled in a metal sheet that constitutes top 410.

The display rack 418 includes a first pin 420*a* and a second pin 420*b* that extend from the bottom of the display rack 418. The first pin 420*a* and the second pin 420*b* are shaped to fit into the keyed openings 416*a-b* and hold the display rack 418 in place. The display rack 418 includes one or more hooks to support jewelry. For example, the display rack 418 includes a hook to present a necklace to a customer. In some implementations, the display rack 418 includes hooks to present earrings to a customer.

The first pin 420*a* and the second pin 420*b* allow the display rack 418 to be placed in different positions on the metal top 410 depending on the products presented on the full height counter 400. In some implementations, more than one display rack is inserted into the keyed openings 416*a-b* for presenting products to a customer.

In some implementations, a necklace display rack 422 is inserted into the keyed openings 416*a-b* for presenting one or more necklaces to a customer. The necklace display rack 422 is positioned on the metal top 410 to allow a customer to easily view and interact with products presented on the necklace display rack 422.

A bracelet display rack 424 includes a vertical bar and a horizontal bar forming a "T." A customer browses through bracelets hanging from the horizontal bar. A bottom end of the vertical bar includes a pin formed to fit into the keyed openings 416*a-b*. The pin allows the bracelet display rack 424 to be placed in any of the keyed openings 416*a-b*. A customer can interact and view bracelets located on the bracelet display rack 424 from any side of the full height counter 400.

An earring display rack 426 presents multiple pairs of earrings to a customer. The earring display rack 426 includes two pins extending from the bottom of the earring display rack 426 that fit into the keyed openings 416*a-b*. The two pins hold the earring display rack 426 in place and allow the earring display rack 426 to be positioned on the metal top 410.

A product display rack 428 presents multiple necklaces and bracelets to a customer. The product display rack 428 includes two pins extending from the bottom of the product display rack 428. The pins are formed to fit into the keyed openings 416*a-b*. In some implementations, the pins fit into two keyed openings that are next to one another. In other implementations, the pins fit into keyed openings that are separated from one another. The pins allow the product display rack 428 to be positioned at different places on the metal top 410.

The keyed openings 416*a-b* allow multiple display racks to be supported by the full height counter 400. In some implementations, the display racks are designed differently to present different types of products to a customer or to present the same type of product to a customer in a different way. The keyed openings 416*a-b* allow multiple display racks to be positioned in different locations on the metal top 410 depending on the products presented on the display racks.

In some implementations, the upper display portion 404 includes a cavity with a light 430. The glass sides 412 allow the light 430 to attract a customer to products presented on the full height counter 400. In some implementations, the metal top 410 is partially made from glass or plastic in order to highlight products presented on the full height counter 400.

Figure 5:
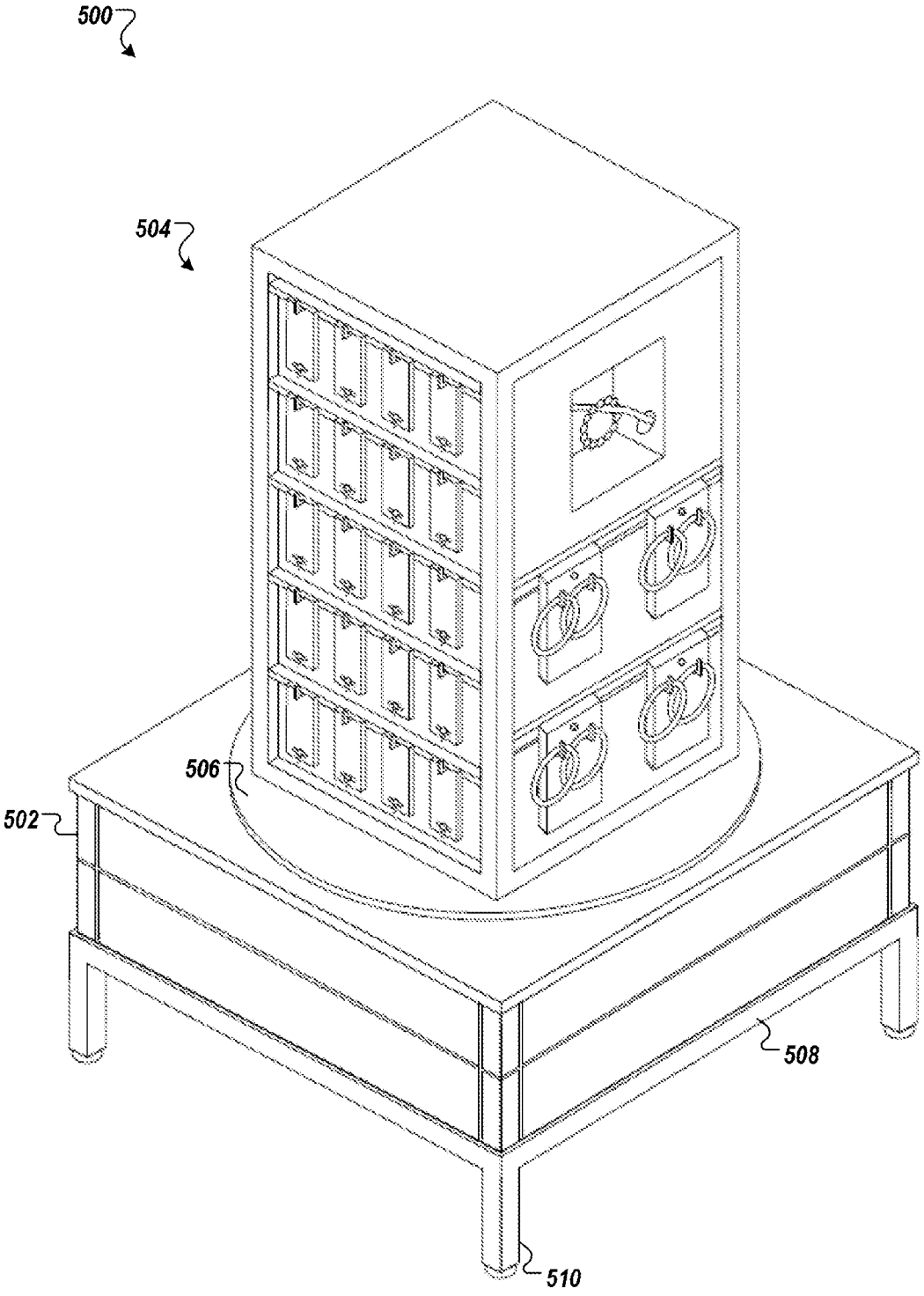
FIG. 5 shows a perspective view of an example section of a display counter with a display spinner on top of the section.

FIG. 5 shows an example of a half height counter 500. The half height counter 500 supports a display spinner for presenting products to a customer. The customer browses through the products on the display spinner by rotating the display spinner. In some implementations, the first corner section 122, the first display section 126, the third display section 130, the first display counter island 106, or the first section 310 are a half height counter (e.g., the half height counter 500).

The half height counter 500 includes a lower base portion 502 and a display spinner 504. The display spinner 504 is made from plastic. A base 506 of the display spinner 504 rests upon the lower base portion 502. In some implementations, the lower base portion 502 includes keyed openings on the top of the lower base portion 502. The base 506 includes multiple rods extending downward from the bottom of the base 506. The rods are received by the keyed openings in the top of the lower base portion 502 and hold the display spinner 504 in place.

The lower base portion 502 is made from wood. The lower base portion 502 includes a bottom panel, a top panel, and four side panels. In some implementations, the lower base portion 502 includes a drawer or a shelf in the interior of the lower base portion 502. In some implementations, the lower base portion 502 is made from plastic. In some implementations, the lower base portion 502 is made from metal.

In some implementations, the half height counter 500 is modular. For example, the lower base portion 502 connects to the upper display portion 404. In some implementations, the upper display portion 404 attaches to the lower base portion 502 with rods that extend downward from the bottom of the upper display portion 404. For example, the rods insert into keyed openings on the top of the lower base portion 502.

The lower base portion 502 has a square horizontal cross section and a rectangular vertical cross section. The lower base portion 502 has a height between about 10 inches and about 20 inches, e.g., a height of about 14 or 15 inches. The lower base portion 502 has a width between about 20 inches and about 40 inches. For example, the lower base portion 502 has a width between about 25 inches and about 30 inches, e.g., a width of about 28 inches. The lower base portion 502 has a depth between about 20 inches and about 40 inches. For example, the lower base portion 502 has a depth between about 25 inches and about 30 inches, e.g., and a depth of about 28 or 30 inches. In some implementations, the lower base portion 502 has a rectangular horizontal cross section. In some implementations, the lower base portion 502 has a square vertical cross section. In some implementations, the lower base portion 502 has a circular horizontal cross section.

The lower base portion 502 is supported by a support frame 508. The support frame 508 includes one or more legs 510. The support frame 508 is made from a single piece of metal. In some implementations, the support frame 508 attaches to four wheels (not shown) that allow the half height counter 500 to be easily moved. In some implementations, the support frame 508 does not include the legs 510. In some implementations, the support frame 508 is made from wood. In some implementations, the support frame 508 is made from plastic.

Figure 6:
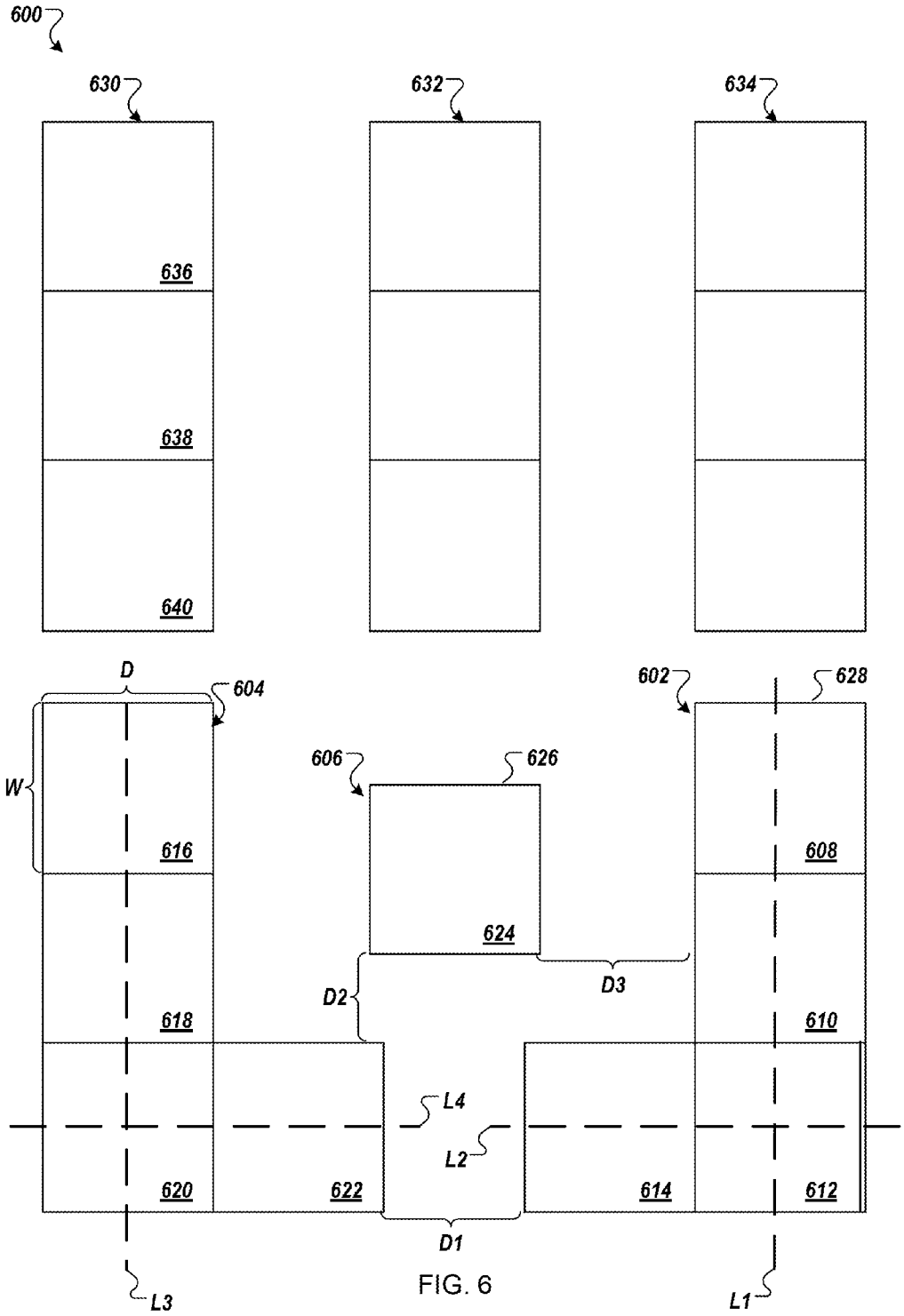
FIG. 6 is a schematic horizontal cross section of a product display system.

FIG. 6 is an example of a floor plan layout 600 for a product display system, such as the product display system 100. The floor plan layout 600 is a horizontal cross section of a product display system. The floor plan layout 600 includes a right "L" shaped counter 602, a left "L" shaped counter 604, and a center display island 606. In some implementations, products are place on the top surfaces of the right "L" shaped counter 602, the left "L" shaped counter 604, and the center display island 606 for presentation to a customer. In some implementations, product supports, such as display spinners, racks, or shelves, rest on the top of the right "L" shaped counter 602, the left "L" shaped counter 604, or the center display island 606.

The right "L" shaped counter 602 includes a first longitudinal portion and a first lateral portion. The first longitudinal portion extends along a first longitudinal axis L1. The first longitudinal portion includes three sections, a first section 608, a second section 610, and a third section 612. The first lateral portion extends along a first lateral axis L2. The lateral axis L2 is perpendicular to the longitudinal axis L1. The first lateral portion includes a fourth section 614. In some implementations, the first longitudinal portion includes between two and eight sections. In some implementations, the first lateral portion includes between one and five sections.

In some implementations, the first section 608, the second section 610, and the fourth section 614 include full height counters, such as the full height counter 400. In some implementations, the first section 608 is a half height counter, such as the half height counter 500. The third section 612 is a half height counter, such as the half height counter 500. In some implementations, the third section 612 is a full height counter.

The left "L" shaped counter 604 includes a second longitudinal portion and a second lateral portion. The second longitudinal portion extends along a second longitudinal axis L3 parallel to the first longitudinal axis L1. The second longitudinal portion includes three sections, a fifth section 616, a sixth section 618, and a seventh section 620. The second lateral portion extends along a second lateral axis L4. The second lateral axis L4 is perpendicular to the second longitudinal axis L3. The second lateral axis L4 coincides with the first lateral axis L2. The second lateral portion includes an eighth section 622. In some implementations, the second longitudinal portion and the second lateral portion include the same number of sections (e.g., they both include three sections).

The fourth section 614 and the eighth section 622 are spaced apart a distance D1. In some implementations, the distance D1 is between about 30 inches and about 80 inches, e.g., about 50 inches.

The fifth section 616 has a width W and a depth D. The width W is between about 25 inches and about 80 inches, e.g., 49¾ inches. The depth D is between about 20 inches and about 40 inches, e.g., about 29¾ inches. In some implementations, both the width W and the depth D are the same (e.g., 29¾ inches). In some implementations, the other sections of the right "L" shaped counter 602 and the left "L" shaped counter 604 have the same dimensions as the fifth section 614.

The center display island 606 includes a ninth section 624. In some implementations, the center display island 606 includes between two and four sections. In some implementations, the center display island is rectangular. In some implementations, the center display island 606 is substantially "U" shaped. In some implementations, the center display island 606 is substantially "T" shaped.

The ninth section 624 is a distance D2 from the eighth section 622. The ninth section 624 is the same distance from the fourth section 614. In some implementations, the distance D2 is between about 30 inches and about 80 inches, e.g., about 36 inches. The ninth section 624 is a distance D3 from the first longitudinal portion. The ninth section 624 is the same distance from the second longitudinal portion. In some implementations, the distance D3 is between about 30 and about 80 inches, e.g., about 60 inches.

A first end 626 of the ninth section 624 does not extend past a second end 628 of the first section 608. In some implementations, the first end 626 extends past the second end 628.

The ninth section 624 is a half height counter, such as the half height counter 500. In some implementations, the ninth section 624 is a full height counter. In some implementations, the center display island 606 includes both a half height counter and a full height counter.

The layout of the right "L" shaped counter 602, the left "L" shaped counter 604, and the center display island 606 allows a customer to access products presented on display counters from all sides of the display counters. For example, a customer is able to interact with products presented on the center display island 606. In some implementations, the floor plan layout 600 creates a sense of being closed in and deters shoplifting.

In some implementations, the floor plan layout 600 includes a first display counter 630, a second display counter 632, and a third display counter 634, which present additional products to a customer. In some implementations, the first display counter 630 is the display counter 308. The display counter includes a first full height section 636, a second full height section 638, and a half height section 640. The first full height section 636 includes keyed openings that mate with product display racks. The half height section 640 includes keyed openings that receive pins extending downward from the bottom of a product display spinner. In some implementations, the second full height section 638 supports shelves. For example, two side supports include pins that insert into keyed openings on the top of the second full height section 638. Products are placed on shelves located between the two side supports.

The keyed openings allow different displays to be attached to a counter for presentation of products in different ways. For example, the same counter is used to support a display spinner during the summer and multiple display racks during the fall.

A number of embodiments have been described. Nevertheless, it will be understood that various modifications are optionally made without departing from the spirit and scope of this disclosure. Accordingly, other embodiments are within the scope of the following claims.

What is claimed is:

1. A display system comprising:

a first counter having a lower base portion and an upper display portion, the upper display portion of the first counter comprising translucent panels, the first counter including a portion extending along a first horizontal longitudinal axis and a portion extending along a first horizontal lateral axis substantially perpendicular to the first horizontal longitudinal axis;

a second counter having a lower base portion and an upper display portion, the upper display portion of the second counter comprising translucent panels, the second counter including a portion extending in a second horizontal longitudinal axis and a portion extending along a second horizontal lateral axis substantially perpendicular to the second horizontal longitudinal axis, wherein the second horizontal longitudinal axis is substantially parallel to the first horizontal longitudinal axis, wherein the first and second horizontal lateral axes are substantially coincident, and wherein the portions of the first and second counters that extend along the horizontal lateral axes extend toward one another and are spaced apart from one another sufficiently to permit a person to walk there between; and a third counter disposed at least partially between the portions of the first and second counters that extend along the horizontal longitudinal axes;

wherein:

the first counter includes a plurality of first counter sections, one of the plurality of first counter sections defines a first section of the lower base portion and the translucent panels of the first counter, the translucent panels of the first counter enclose a hollow interior having a light maintained therein such that the translucent panels of the first counter are backlit from the hollow interior of the corresponding one of the plurality of first counter sections, the translucent panels of the first counter extend around a substantial entirety of an outermost periphery of the one of the plurality of first counter sections in a manner covering a top of the first section of the lower base portion of the first counter, the first section of the lower base portion of the first counter is attached to a separately formed, single piece metal support frame including one or more legs maintaining the first section of the lower base portion spaced from and above a supporting surface, the upper display portion of the first counter includes a metal top extending over the hollow interior and four of the translucent panels, which extend around an entire periphery of the hollow interior to surround the light, such that the display system is configured to only display jewelry on a side of the metal top opposite the four of the translucent panels of the first counter, and the metal top includes a plurality of uniformly shaped sockets to receive a plurality of differently configured jewelry display racks that have downwardly extending portions configured to mate with the sockets.

2. The system of claim 1, wherein the third counter is substantially completely disposed between the portions of the first and second counters that extend along the horizontal longitudinal axes.

3. The system of claim 2, wherein the third counter is substantially completely disposed between the portions of the first and second counters extending along the horizontal lateral axes and a system boundary linearly defined between opposing ends of the portions of the first and second counters extending along the horizontal longitudinal axes.

4. The system of claim 1, wherein the third counter portion has a display surface at a height substantially less than a substantial portion of the display surface of the first or second counter.

5. The system of claim 1, wherein the first and second counters have jewelry displayed thereon.

6. The system of claim 1, wherein the third counter has jewelry displayed thereon.

7. The system of claim 1, wherein the third counter includes an upper display portion and a lower base portion.

8. The system of claim 7, wherein the upper display portion of the third counter includes translucent panels which are backlit from an internal cavity of the third counter.

9. The system of claim 1, wherein each of the plurality of first counter sections has a rectangularly shaped top surface, a first group of the plurality of separate sections are arranged to define the first counter, the second counter is formed by a plurality of second counter sections substantially identical to, but formed separately from the plurality of first counter sections.

10. The system of claim 1, wherein:

the first counter and the second counter are each characterized by only being configured to display product on top of each of the first and second counters, each of the translucent panels is frosted.

11. A display system comprising:

a first counter having a lower base portion and an upper display portion, the upper display portion of the first counter comprising translucent panels, the first counter including a portion extending along a first horizontal longitudinal axis and a portion extending along a first horizontal lateral axis substantially perpendicular to the first horizontal longitudinal axis;

a second counter having a lower base portion and an upper display portion, the upper display portion of the second counter comprising translucent panels, the second counter including a portion extending in a second horizontal longitudinal axis and a portion extending along a second horizontal lateral axis substantially perpendicular to the second horizontal longitudinal axis, wherein the second horizontal longitudinal axis is substantially parallel to the first horizontal longitudinal axis, wherein the first and second horizontal lateral axes are substantially coincident, and wherein the portions of the first and second counters that extend along the horizontal lateral axes extend toward one another and are spaced apart from one another sufficiently to permit a person to walk there between; and a third counter disposed at least partially between the portions of the first and second counters that extend along the horizontal longitudinal axes;

wherein:

each of the first and second counters have a top panel that includes a plurality of uniformly shaped sockets to receive a plurality of differently configured jewelry display racks that have downwardly extending portions configured to mate with the sockets, the translucent panels of the first counter collectively define a light chamber extending from a first outermost edge of the first counter to a second outermost edge of the first counter to cover a section of the lower base portion below the translucent panels, the second outermost edge is opposite the first outermost edge, the top panel of the first counter covers the top surface of the light box, the first counter includes a light in the light chamber to backlight the translucent panels, the translucent panels of the first counter enclose a hollow interior having a light maintained therein such that the translucent panels of the first counter are backlit from the hollow interior of the first counter, the lower base portion of the first counter is attached to a separately formed, single piece metal support frame including one or more legs maintaining the lower base portion spaced from and above a supporting surface;

the top panel of the first counter extends over the hollow interior and four of the translucent panels extending around the hollow interior to surround the light, each of the translucent panels is frosted, and the top panel is metal and includes a plurality of uniformly shaped sockets to receive a plurality of differently configured jewelry display racks that have downwardly extending portions configured to mate with the sockets such that the first counter is configured to only display jewelry on top of the top panel of the first counter.

12. The system of claim 11, further comprising the plurality of differently configured jewelry display racks each being coupled with a different corresponding one of the plurality of uniformly shaped sockets by placing the downwardly extending portion of each of the plurality of differently configured jewelry display racks into the different corresponding one of the plurality of uniformly shaped sockets.

13. The system of claim 12, wherein the downwardly extending portion of each of the plurality of differently configured jewelry display racks securely fits within any one of the plurality of uniformly shaped sockets.

14. The system of claim 11, further comprising a display spinner defining a bottom surface and rods extending downwardly from the bottom surface, the display spinner being selectively coupled to the first counter via placement of the rods into corresponding ones of the plurality of uniformly shaped sockets.

15. A display system comprising:

a first counter having a lower base portion and an upper display portion, the upper display portion of the first counter comprising transparent or translucent panels, the first counter including a portion extending along a first horizontal longitudinal axis and a portion extending along a first horizontal lateral axis substantially perpendicular to the first horizontal longitudinal axis;

a second counter having a lower base portion and an upper display portion, the upper display portion of the second counter comprising transparent or translucent panels, the second counter including a portion extending in a second horizontal longitudinal axis and a portion extending along a second horizontal lateral axis substantially perpendicular to the second horizontal longitudinal axis, wherein the second horizontal longitudinal axis is substantially parallel to the first horizontal longitudinal axis, wherein the first and second horizontal lateral axes are substantially coincident, and wherein the portions of the first and second counters that extend along the horizontal lateral axes extend toward one another and are spaced apart from one another sufficiently to permit a person to walk there between; and a third counter disposed at least partially between the portions of the first and second counters that extend along the horizontal longitudinal axes;

wherein the first counter includes a corner section at the intersection of the portion of the first counter extending along the first horizontal longitudinal axis and the portion of the first counter extending along the first horizontal lateral axis, the corner section being void of the transparent or translucent panels and having an overall height less than an overall height of a remainder of the first counter wherein:

one of the portions of the first counter defines the translucent panels of the first counter in a manner enclosing a hollow interior having a light maintained therein such that the translucent panels are backlit from the hollow interior of the corresponding one of the portions of the first counter, the lower base portion of the first counter is attached to a separately formed, single piece metal support frame including one or more legs maintaining the lower base portion spaced from and above a supporting surface;

the upper display portion includes a metal top extending over the hollow interior and four of the translucent panels extending around an entire periphery of the hollow interior to surround the light, each of the translucent panels is frosted, and the metal top includes a plurality of uniformly shaped sockets to receive a plurality of differently configured jewelry display racks that have downwardly extending portions configured to mate with the sockets such that the one of the portions of the first counter is configured to only display jewelry above the metal top.

16. The system of claim 15, further comprising a display spinner positioned on top of the corner section such that the display spinner extends upwardly from the top of the corner section above topmost surfaces of the first counter.

17. The system of claim 15, wherein the third counter has an overall height less than the overall height of the remainder of the first counter.

18. The system of claim 15, wherein:

the portion of the first counter extending along the first horizontal longitudinal axis comprises one or more substantially identical first sections, the portion of the first counter extending along the first horizontal lateral axis comprises one or more substantially identical second sections that are each substantially identical to any one of the one or more substantially identical first sections, one of the substantially identical first sections includes the lower base portion and the upper display portion of the first counter, and the corner section includes a corner section lower base portion, which has a substantially identical outer appearance as the lower base portion of the one of the substantially identical first sections and is caped by a top panel, the top panel forming the topmost surface of the corner section.

19. A display system comprising:

a first counter having a lower base portion and an upper display portion, the upper display portion comprising translucent panels, the first counter including a portion extending along a first horizontal longitudinal axis and a portion extending along a first horizontal lateral axis substantially perpendicular to the first horizontal longitudinal axis;

a second counter having a lower base portion and an upper display portion, the upper display portion comprising translucent panels, the second counter including a portion extending in a second horizontal longitudinal axis and a portion extending along a second horizontal lateral axis substantially perpendicular to the second horizontal longitudinal axis, wherein the second horizontal longitudinal axis is substantially parallel to the first horizontal longitudinal axis, wherein the first and second horizontal lateral axes are substantially coincident, and wherein the portions of the first and second counters that extend along the horizontal lateral axes extend toward one another and are spaced apart from one another sufficiently to permit a person to walk there between; and a third counter disposed at least partially between the portions of the first and second counters that extend along the horizontal longitudinal axes;

wherein:

the first counter includes a plurality of first counter sections, one of the plurality of first counter sections defines the translucent panels of the first counter in a manner enclosing a hollow interior having a light maintained therein such that the translucent panels are backlit from the hollow interior of the corresponding one of the plurality of first counter sections, the lower base portion is attached to a separately formed, single piece metal support frame including one or more legs maintaining the lower base portion spaced from and above a supporting surface;

the upper display portion includes a metal top extending over the hollow interior and four of the translucent panels extending around an entire periphery of the metal top to surround the light, each of the translucent panels is frosted, and the metal top includes a plurality of uniformly shaped sockets to receive a plurality of differently configured jewelry display racks that have downwardly extending portions configured to mate with the sockets such that the system is configured to only display jewelry above the metal top.

* * * * *